United States Patent [19]

Saunders

[11] 3,998,174

[45] Dec. 21, 1976

[54] LIGHT-WEIGHT, HIGH-STRENGTH, DRAWN AND IRONED, FLAT ROLLED STEEL CONTAINER BODY METHOD OF MANUFACTURE

[75] Inventor: William T. Saunders, Weirton, W. Va.

[73] Assignee: National Steel Corporation, Pittsburgh, Pa.

[22] Filed: Aug. 7, 1975

[21] Appl. No.: 602,727

[52] U.S. Cl. ..... 113/120 H; 72/348; 72/349

[51] Int. Cl.[2] ..... B21D 51/10; B21D 22/30

[58] Field of Search .... 113/120 R, 120 H, 120 QA, 113/120 V, 120 AA, 1 G; 72/347, 348, 349; 220/66, 70

[56] References Cited

UNITED STATES PATENTS

| | | | |
|---|---|---|---|
| 2,339,763 | 1/1944 | Calleson | 113/120 R |
| 3,434,626 | 3/1969 | Kinslow | 220/66 |
| 3,556,032 | 1/1971 | Fraze | 113/120 H |
| 3,603,275 | 9/1971 | Eickenhorst | 113/120 H |
| 3,610,018 | 10/1971 | Swanson et al. | 72/348 |
| 3,690,507 | 9/1972 | Gailus et al. | 220/66 |
| 3,733,881 | 5/1973 | Grigorenlo | 113/120 H |
| 3,785,311 | 1/1974 | Yoshikawa | 113/120 H |
| 3,855,862 | 12/1974 | Moller | 72/349 |
| 3,924,437 | 12/1975 | Hörtig | 72/349 |

*Primary Examiner*—Leon Gilden
*Attorney, Agent, or Firm*—Shanley, O'Neil and Baker

[57] ABSTRACT

A light-weight unitary can body for pressure packs, such as carbonated beverage containers, is produced from high tensile strength steel. Flat rolled container stock steel is double cold reduced without an intermediate anneal. This material is drawn and ironed, and a bottom profile is formed while the can body is mounted on the ironing mandrel. The bottom profile includes a rounded-bottom annular chime and recessed convex panel. Formation of the bottom profile breaks surface adhesion between the ironing mandrel and the interior of the can body facilitating removal of the can body. The open end of the can body is necked-in to accommodate a closure chime seam within the diameter of the main portion of the can body sidewall.

3 Claims, 9 Drawing Figures

FIG. 1
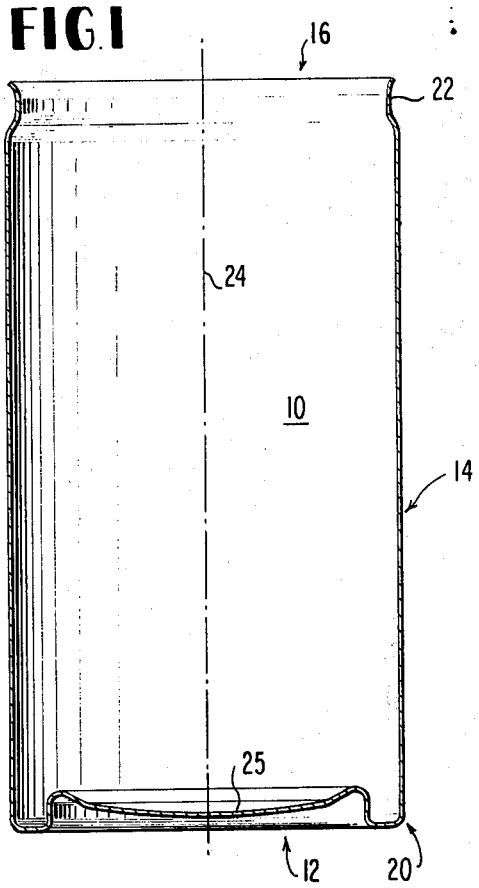
FIG. 2
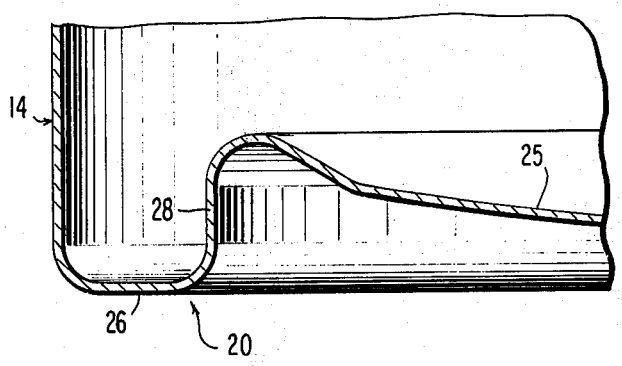
FIG. 3
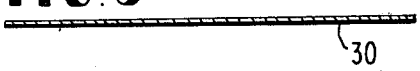
FIG. 4
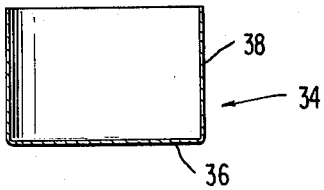
FIG. 5
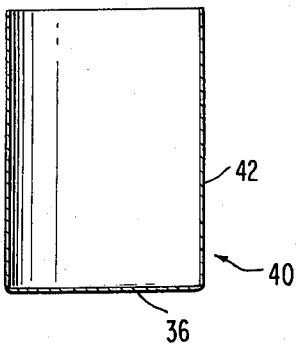
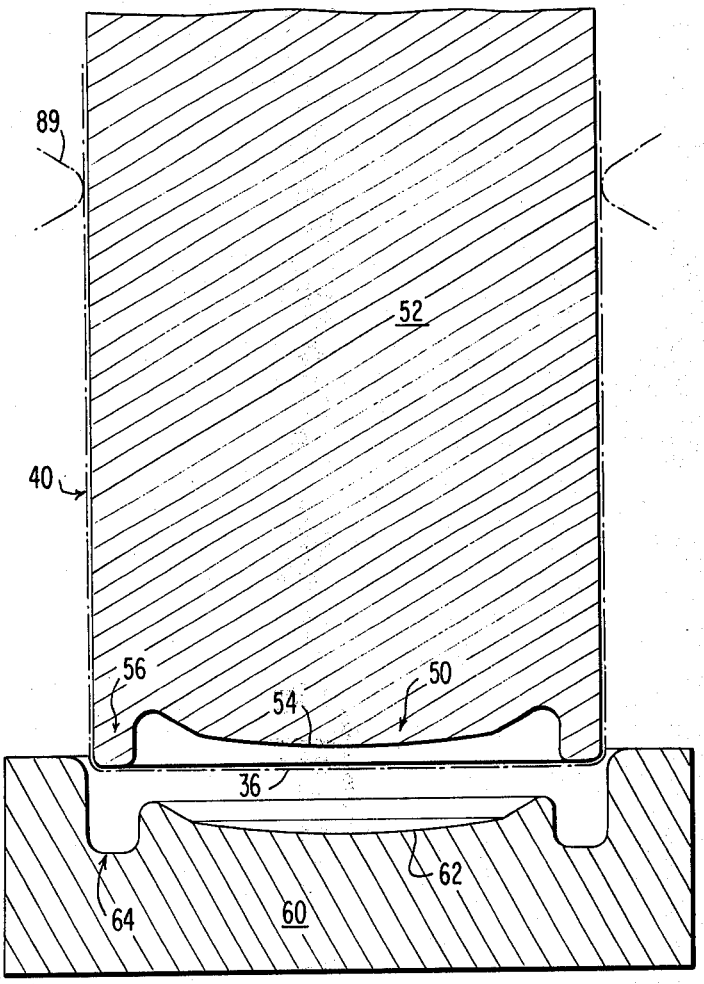
FIG. 6

FIG. 7
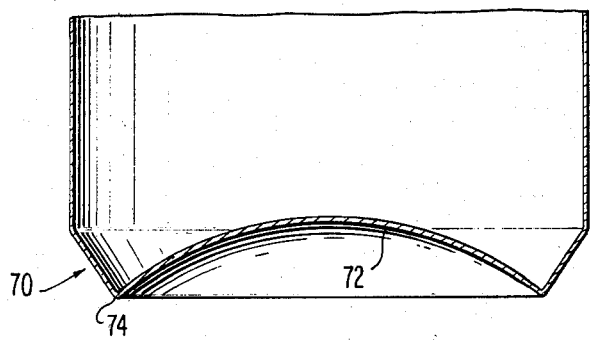
FIG. 8
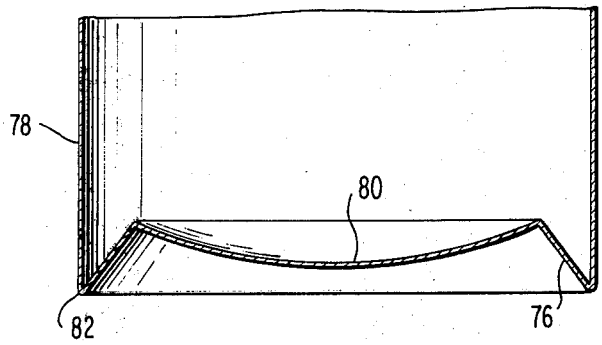
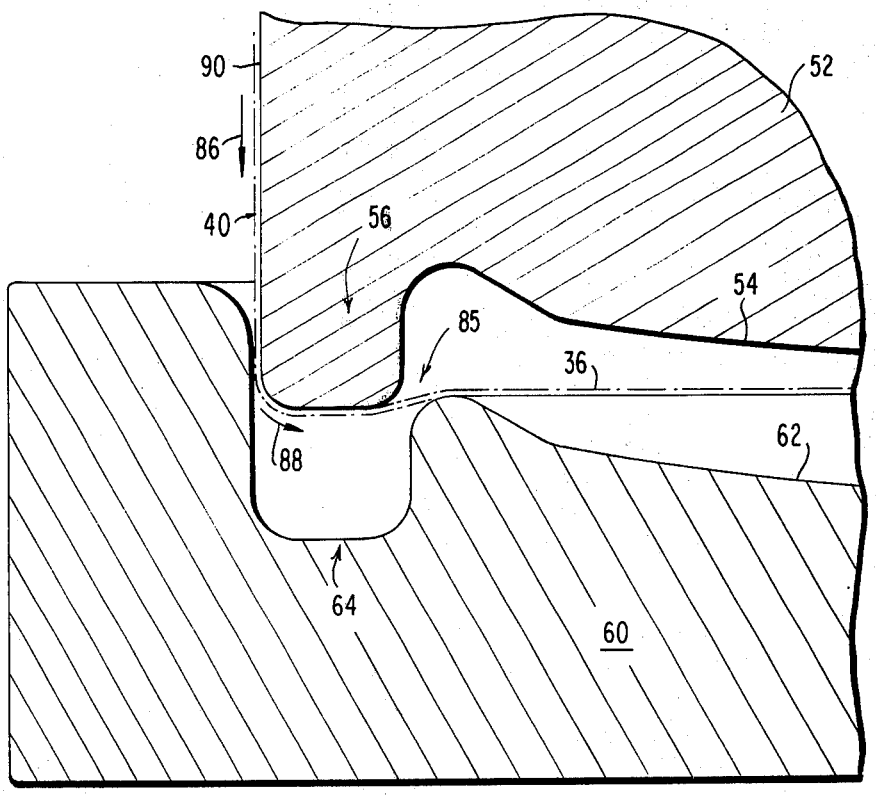
FIG. 9

LIGHT-WEIGHT, HIGH-STRENGTH, DRAWN AND IRONED, FLAT ROLLED STEEL CONTAINER BODY METHOD OF MANUFACTURE

The invention is concerned with manufacture of a light-weight, high-strength, drawn and ironed, flat rolled steel unitary can body and a bottom wall profile for such a can body.

For reasons of economy and conservation of material a demand exists for a lighter than conventional weight steel can body of sufficient strength to withstand the pressures of carbonated beverage packs. The present teachings uniquely develop such properties in flat rolled steel and, through formation steps for such steel, provide an economic, light-weight, high tensile strength steel can body.

Flat rolled steel having such high tensile strength characteristics is produced by tandem cold reductions of steel container stock without intermediate anneal. For example, double cold reductions of tinplate or blackplate stock, first to about 135 pounds per base box (around 0.015 inch thickness gage or 0.35 to 0.4mm) then to about 95 pounds per base box (around 0.010 inch thickness gage or about 0.25mm) are carried out without intermediate anneal. This high tensile strength steel is then drawn into a cup shape and the sidewall ironed to produce the desired economically light-weight can bodies. The weight of the steel in such a can body is considerably less than that of the can body for the conventional three-piece container. Also, the bottom chime seam, the sidewall seam, and the soldering required with conventional three-piece containers are eliminated.

By proper selection of surface finishes for the flat rolled steel, and improvements in mandrel surface and lubrication techniques, e.g. as described in applicants's co-pending applications Ser. No. 561,832, "Improved Drawing and Ironing Container Stock and Manufacturing Methods", filed Mar. 25, 1975 and Ser. No. 559,056, "Structure and Method Facilitating Stripping of Seamless Can Body from Ironing Mandrel", filed Mar. 17, 1975, drawing and ironing of desired tensile strength steel, e.g. semi-full hard steel, is facilitated. However, removal of a can body from the mandrel after ironing can present additional difficulties because of the tight surface adhesion developed with the mandrel during ironing of such material. Further, a bottom wall configuration of suitable physical characteristics for pressure packs when made from such light-weight materials has not been available. These surface adhesion and bottom wall profile problems are relieved simultaneously by the present invention.

These and other contributions of the invention will be more evident from further detailed description of structures and operations depicted by the accompanying drawings. In such drawings:

FIG. 1 is a cross-sectional schematic view of an embodiment of the invention;

FIG. 2 is an enlarged view of a portion of the unitary closed end of the can body of FIG. 1;

FIG. 3 is a cross-sectional view of a cut blank of container stock;

FIG. 4 is a cross-sectional view of a shallow depth cup drawn from the blank of FIG. 3;

FIG. 5 is a cross-sectional view of an ironed sidewall article formed from the drawn cup of FIG. 4;

FIG. 6 is a cross-sectional schematic view of bottom profile forming structures of the present invention with the can body being ironed mounted on the mandrel, the can body and an ironing ring are shown in dotted lines;

FIG. 7 is a cross-sectional view of a conventional bottom profile;

FIG. 8 is a cross-sectional view of another prior art bottom profile;

FIG. 9 is an enlarged view of a portion of FIG. 6 during formation of the bottom profile.

Can body 10 of FIG. 1 is formed from a single piece of flat rolled steel and comprises endwall structure 12, a unitary sidewall 14, and an open end 16 longitudinally opposite to endwall 12. The major portion of sidewall 14 is of uniform diameter. That is, between bottom chime portion 20 and necked-in flanging metal portion 22, the sidewall is uniformly spaced radially from centrally located longitudinal axis 24.

Endwall structure 12 includes a recessed panel 25 of circular configuration with annular bottom chime portion 20. As shown, panel 25 covers the major portion, approximately 85 percent, of the area of endwall 12 with the remainder of such area comprising the annular chime 20. An important configurational aspect of the invention which should be noted from this view is that recessed panel 25 has a convex configuration as viewed from the exterior of the can body.

Chime portion 20 is annular in end view but, as shown in radial cross-sectional view in FIGS. 1 and 2, has a U-shaped configuration. Chime portion 20 includes a rounded bottom edge 26 and a cylindrical configuration inner leg 28. Such chime portion inner leg 28 is substantially parallel to sidewall 14.

An important contribution of the bottom wall profile of FIGS. 1 and 2 is that formation of this profile on the ironing mandrel, as taught by the present invention, facilitates stripping of the ironed sidewall can body from the ironing mandrel. Whereas formation of the conventional bottom wall profile, if performed while mounted on an ironing mandrel, would have the effect of increasing the gripping force on the mandrel. The rounded bottom edge configuration of the chime 20 also eliminates the relatively sharp edge bottom configuration of conventional beverage containers which bottom edge configuration would be dent prone with the light-weight materials taught.

Double cold reductions, without an intermediate anneal, is a preferred method for producing relatively high-tensile strength flat rolled steel to provide a light-weight can body of suitable strength for pressure packs. Flat rolled steel container stock is first cold reduced to a weight of about 135 pounds per base box then to a weight of about 95 pounds per base box without an intermediate anneal. Working with low carbon steel (about 0.02 to 0.12 C.) such cold reductions produce flat rolled steel in a semi-hard condition, i.e. approaching full hard condition as opposed to the relatively soft condition of annealed stock, or the semi-soft condition of annealed stock which has been temper rolled. Circular blanks, such as 30 of FIG. 3, having a thickness gage of about 0.008 inches (0.2mm) to about 0.011 inch (0.28mm) are cut from this semi-hard, double reduced flat rolled steel container stock. The tensile strength of such material is in the range of about 80,000 to about 120,000 psi.

Container blank 30 is then formed into a relatively shallow depth cup 34 as shown in FIG. 4. Cup 34 includes a bottom wall 36 and a unitary sidewall 38 with the bottom wall 36, in the cross-sectional view shown, being in substantially right angled relationship to sidewall 38. Drawing of the cup 34 is carried out without substantial change in the thickness gage of the sheet metal.

The sidewall 38 of the shallow cup 34 is then ironed. Cutting of the blank 30, forming of the shallow depth cup 34 and ironing of the sidewall to form the can body 40 can be carried out as part of a single operational procedure with apparatus which is well known in the art; for example see U.S. Pat. Nos. 3,203,218 and 3,670,543.

In the ironing operation the sidewall 38 of the shallow cup is elongated and thinned to form can body 40 of FIG. 5. During ironing to form elongated sidewall 42 the thickness of cup sidewall 38 can be reduced to thickness gage of about 0.0025 inch to about 0.004 inch (about 0.065mm to about 0.1mm). Ironing of the cup sidewall further increases the tensile strength of the steel. An intimate surface contact develops while ironing such material and a tight surface adhesion between the can body sidewall and the mandrel results. An important contribution of the invention is the breaking of this surface adhesion as a part of the formation of the bottom wall profile of the invention.

The bottom wall profile of the present invention is formed while can body 40 is mounted on the ironing mandrel and the bottom wall is supported during profiling so as to eliminate the formation of buckles. Conventional beverage can containers have a dome shaped bottom profile. Using conventional methods, it is difficult to form such dome shape on light-weight steel without buckle lines (extending radially toward the outer periphery) being created as the dome is formed, rather than a smooth continuous surface as desired in a bottom wall configuration.

The tooling configurations provided by the present invention which eliminate these problems are shown in FIG. 6. Working end 50 of mandrel 52 includes a configuration conforming to the desired bottom wall profile of the present invention and includes a convex panel 54 and annular bottom male chime shape 56. The bottom profile forming tool 60 includes a concave panel portion 62 and annular, round-bottom, female chime forming portion 64. As ironing mandrel 52 and female forming tool 60 are brought together the convex panel 25 and chime 20 with rounded bottom 26 (FIG. 2) are formed. The chime portion 20 includes interior leg 28 which is substantially parallel to sidewall 14.

In the conventional bottom wall profiles for two-piece beverage containers, the metal is angled from a panel area toward the chime area. For example, in FIG. 7 chime metal 70 is angled toward the periphery of panel 72 resulting in a relatively pointed bottom edge 74. In the conventional bottom profile of FIG. 8 the angled chime metal 76 is located inside of the peripheral sidewall 78 and leads toward dome 80. This also results in a relatively pointed bottom edge 82. These sharp edge bottom profiles are prone to denting and outward bulging at the angled portions leading to the sharp edges due to internal pressure. Also, steel can bodies of these configurations, if formed on an ironing mandrel would have the effect of tightening the metal, i.e. increasing the grip of the can body metal on the bottom of the ironing mandrel.

These conventional configurations can increase the force required for removal of an ironed can body. When using internal pneumatic pressure for removal the force required can often cause bulging so that these profiles require relatively heavy gauge material to avoid such bulging effect. Similarly heavy gauge material is required to avoid bulging due to pressurized contents. The cylindrical internal wall 28 and rounded chime portion 26 help to eliminate this bulging tendancy.

Problems related to removal of an ironed sidewall can body result from surface adhesion built up between the ironed sidewall of the can body and the peripheral sidewall of the ironing mandrel. This surface adhesion or surface bonding effect is due to the forces applied during ironing which establishes an intimate contact between the interior of the can body sidewall and the exterior peripheral surface of the ironing mandrel.

The bottom profile and method of forming that profile of the present invention help break the surface adhesion built up during ironing. Referring to FIG. 9, as the metal is contacted at juncture 85 between ironing mandrel chime portion 56 and female chime portion 64, the metal is thus clamped around the full periphery of the panel 54 substantially at initiation of the bottom profile forming operation; the latter helps prevent buckle formation during formation of the recessed panel because of the support provided about the full periphery. Metal clearance exists for the interior wall 28 while this metal is held and the recessed panel is formed with a substantially full contact of panel 54 which substantially eliminates buckle formation.

With continued movement together of ironing mandrel 52 and forming tool 60 this tight contact of the metal results in a downwardly directed force being exerted on the sheet metal of the can body sidewall 40 as shown by arrows 86 and 88 (FIG. 9) during formation of the rounded bottom edge 26 and the inner leg 28. This force on, and/or resulting movement of, metal breaks the surface adhesion established by ironing rings, such as 89 of FIG. 6, between the ironed sidewall of can body 40 and the outer periphery sidewall surface 90 of ironing mandrel 52. Continued movement together of male member 56 and female member 64 forms the bottom configuration of FIG. 1. The rounded chime area formed is less dent prone than the conventional configurations. The cylindrical configuration of interior wall 28 is bulge resistant and panel 25 is formed without buckles because of the support during formation. Further, because of the slightly convex configuration of panel 25 the relatively thin flat rolled steel easily withstands the internal pressure under tension because of its high tensile strenght.

After ironing and removal a longitudinally straight sidewall is presented between the open end and the bottom closed end. Since there is no chime seam on the bottom end, the sheet metal contiguous to the open end must be necked-in to provide for a closure seam of no greater diameter than the main body of the can sidewall. As shown in FIG. 1, the necked-in flanging metal protion 22 includes cylindrical configuration flanging metal of reduced diameter and a curvilinear transition zone between the reduced diameter flanging metal and the main body portion of the can sidewall. Conventional methods for carrying out this necking-in operation in a single step operation are known in the art.

However, after ironing of the light-weight sidewall metal of the present invention, the sidewall metal is in substantially full-hard condition. With conventional seaming practice cracking of the metal may result in an unacceptable percentage of the can bodies. Some relief in the full-hard condition of the metal can be provided. This can be accomplished by use of a double step necking-in operation which initially compresses metal contiguous to the open end which apparently softens flanging metal for the double seaming operation. This double step necking-in can be carried out in several ways, see e.g. applicant's co-pending applications Ser. No. 490,281, "Methods for Necking-In Sheet Metal Can Bodies", filed July 22, 1974 and Ser. No. 490,277, "Forming Small Diameter Opening for Aerosol Screw Cap, or Crown Cap by Multistage Necking-In of Drawn or Drawn and Ironed Container Body", filed July 22, 1974. These methods utilize an initial compression step before final formation of flanging metal.

In a typical carbonated beverage can body having a height of about 4.8 inches (about 122mm) cylindrical configuration flanging metal has a longitudinal height of about three sixteenth inches (about 4.75mm) and a diameter equal to about 85 percent to 95 percent of the main body portion of the sidewall. The bottom profile interior wall 28 has a longitudinal height of about 0.3 inch (about 7.5mm). Any of the known closure endwalls, solid or easy open, can be applied to the open end of the container.

The invention provides a high-strength, lightweight steel can body for pressure pack usage. Modifications, such as changes in dimensions from those set forth in describing a specific embodiment, are available without departing from the inventive concept therefore, the scope of the invention is to be determined from the appended claims.

What is claimed is:

1. Method of manufacturing a sheet metal can body of high tensile strength flat rolled steel container plate which has been double reduced by cold rolling without an intermediate anneal to a thickness gage of about 0.008 inch to about 0.011 inch comprising the steps of providing a flat rolled steel sheet metal blank of high tensile strength steel having a thickness gage of about 0.008 inch to about 0.011 inch, such flat rolled steel being characterized by tensile strength of about 80,000 to 120,000 psi, drawing the sheet metal blank into a cup having an endwall and unitary sidewall defining an open end longitudinally opposite to the endwall such that the unitary sidewall is substantially uniformly spaced from a longitudinal axis centrally disposed of the cup being drawn with the drawing of the sheet metal blank into such up-shaped configuration taking place without substantially changing the gage of the flat rolled steel, and the endwall of such cup having a substantially planar configuration and being disposed in substantially right angled relationship to such central longitudinal axis, providing an ironing mandrel having a sidewall uniformly spaced from its central longitudinal axis and a bottom-wall profile-forming configuration at its working end longitudinally opposite to its work input end, such bottomwall profile-forming configuration of the ironing mandrel having a recessed endwall of circular configuration having a diameter equal to approximately 85 percent of the diameter of the mandrel sidewall, ironing the unitary sidewall of such cup while mounted on the ironing mandrel without substantially changing the thickness gage of the endwall forming a can body with an elongated sidewall of lighter gage than its bottom wall, and forcing the interior surface of such unitary sidewall into intimate contact with the mandrel sidewall and causing tight adherence between such intimately contacted surfaces, forming a bottom wall profile in the can body while the can body is mounted on the ironing mandrel to provide a circular configuration recessed panel having a diameter of approximately 85 percent of the diameter of the unitary sidewall, the recessed panel having a convex configuration as viewed from the exterior of the can body, and an annular chime portion joining the recessed panel to the sidewall, the annular chime having a U-shaped configuration in radial cross-section with a rounded bottom configuration and an interior leg of substantially cylindrical configuration, the interior leg of the bottom wall profile being disposed substantially parallel to the unitary sidewall of the can body, with the recessed panel being formed by a male die member contacting bottom sheet metal of the can body about the full periphery of the reduced diameter circular configuration panel and interfitting with the circular configuration recessed endwall of the ironing mandrel such that formation of such bottom wall profile exerts a pulling force on the ironed sheet metal in the sidewall of the can body, such pulling force breaking surface adhesion between the interior surface of the unitary sidewall of the can body and the sidewall of the mandrel so as to facilitate removal of the can body from the ironing mandrel, removing the ironed sidewall with recessed panel bottom configuration can body from the ironing mandrel, and necking-in sheet metal contiguous to the open end of the can body to reduce the diameter of such sheet metal and to form flanging metal of cylindrical configuration and a curvilinear configuration transition zone between such reduced diameter cylindrical configuration flanging metal and the remainder of the sidewall of the can body.

2. The method of claim 1 in which such necking-in operation is carried out by multiple-step reductions in diameter of the sidewall sheet metal contiguous to the open end of the can body.

3. The method of claim 1 in which the sidewall of the drawn cup is reduced by ironing to a thickness gage of 0.0025 inch to about 0.004 inch.

* * * * *